US006849589B2

(12) United States Patent
Liu

(10) Patent No.: US 6,849,589 B2
(45) Date of Patent: Feb. 1, 2005

(54) CLEANING COMPOSITION

(75) Inventor: Augustine Liu, Bloomington, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 71 days.

(21) Appl. No.: 09/974,388

(22) Filed: Oct. 10, 2001

(65) Prior Publication Data

US 2003/0114341 A1 Jun. 19, 2003

(51) Int. Cl.[7] ..... C11D 7/50

(52) U.S. Cl. ..... 510/365; 510/417; 510/238; 510/432; 510/506

(58) Field of Search ..... 510/365, 432, 510/424, 417, 506, 238, 434, 504, 433, 405, 421, 470

(56) References Cited

U.S. PATENT DOCUMENTS

| | | | | |
|---|---|---|---|---|
| 2,710,843 | A | 6/1955 | Stebleton | 252/158 |
| 2,901,433 | A | 8/1959 | Spring | 252/118 |
| 2,929,789 | A | 3/1960 | Pickett et al. | 252/153 |
| 2,958,593 | A | 11/1960 | Hoover et al. | 51/295 |
| 3,202,714 | A | 8/1965 | Zimmerer et al. | 260/584 |
| 3,367,878 | A | 2/1968 | Mankowich | 252/110 |
| 3,463,735 | A | 8/1969 | Stonebraker et al. | 252/137 |
| 3,553,144 | A | 1/1971 | Murphy | 252/158 |
| 3,615,827 | A | 10/1971 | Murphy | 134/38 |
| 3,634,338 | A | 1/1972 | Laugle et al. | 252/525 |
| 3,664,962 | A | 5/1972 | Kelly et al. | 252/125 |
| 3,696,043 | A | 10/1972 | Labarge et al. | 252/153 |
| 3,806,460 | A | 4/1974 | Mukai et al. | 252/111 |
| 3,872,021 | A | 3/1975 | McKnight | 252/121 |
| 3,882,038 | A | 5/1975 | Clayton et al. | 252/162 |
| 3,917,850 | A | 11/1975 | Boucher | 424/333 |
| 3,928,249 | A | 12/1975 | Nunziata et al. | 252/526 |
| 3,939,090 | A | 2/1976 | Zmoda | 252/90 |
| 3,943,234 | A | 3/1976 | Roggenkamp | 424/343 |
| 3,948,819 | A | 4/1976 | Wilde | 252/545 |
| 4,013,607 | A | 3/1977 | Dwyer et al. | 260/29.6 H |
| 4,017,409 | A | 4/1977 | Demessemaekers | 252/109 |
| 4,040,977 | A | 8/1977 | Eggensperger et al. | 252/401 |
| 4,144,201 | A | 3/1979 | Winterbotham et al. | 252/547 |
| 4,174,304 | A | 11/1979 | Flanagan | 252/542 |
| 4,175,062 | A | 11/1979 | Disch et al. | 252/540 |
| 4,203,872 | A | 5/1980 | Flanagan | 252/542 |
| 4,225,471 | A | 9/1980 | Claus et al. | 252/547 |
| 4,235,734 | A | 11/1980 | Scherubel | 252/142 |
| 4,240,919 | A | 12/1980 | Chapman | 252/95 |
| 4,254,104 | A | 3/1981 | Suzuki | 424/170 |
| 4,264,466 | A | 4/1981 | Carleton et al. | 252/99 |
| 4,264,729 | A | 4/1981 | Beljanski | 435/6 |
| 4,297,251 | A | 10/1981 | Bernardino | 252/545 |
| 4,348,292 | A | 9/1982 | Ginn | 252/90 |
| 4,414,128 | A | 11/1983 | Goffinet | 252/111 |
| 4,460,374 | A | 7/1984 | Abel et al. | 8/501 |
| 4,472,291 | A | 9/1984 | Rosano | 252/186.28 |

(List continued on next page.)

FOREIGN PATENT DOCUMENTS

| | | |
|---|---|---|
| EP | 0 040 882 | 12/1981 |
| EP | 0 130 786 | 1/1985 |
| EP | 0 518 401 | 5/1992 |
| EP | 0 666 308 | 8/1995 |
| FR | 1 061 718 | 4/1954 |
| FR | 1 207 745 | 2/1960 |
| FR | 2 571 279 | 4/1986 |
| FR | 2 582 546 | 12/1986 |
| GB | 782898 | 9/1957 |
| GB | 1 240 469 | 7/1971 |
| GB | 1 602 234 | 11/1981 |
| GB | 2 166 153 | 4/1986 |
| JP | 52-77111 | 6/1977 |
| JP | 54-14406 | 2/1979 |
| JP | 56-22397 | 3/1981 |
| JP | 57-28199 | 2/1982 |
| JP | 57-83598 | 5/1982 |
| JP | 58-185700 | 10/1983 |
| JP | 59-70652 | 4/1984 |
| JP | 4076099 | 3/1992 |
| WO | WO91/00336 | 1/1991 |
| WO | WO91/00337 | 1/1991 |
| WO | WO94/22965 | 10/1994 |
| ZA | 95/2570 | 3/1995 |

OTHER PUBLICATIONS

Exxon Chemical Co., *Product Literature*, "Non–Butyl Cleaners", Dec. 1980 pp. 2.

Exxon Chemical Co., *Product Literature*, "1992 Formulary" (Mar. 8, 1989) pp. 1–14.

International Specialty Products, *Product Literature*, "Surfadone® LP Specialty Solvents and Surfactants", (1992) pp. 1–5.

Mellan, L, "Glycol Ethers", *Industrial Solvents Handbook*, (Jun. 1977) pp. 346–349, 565.

Kururay Co., Ltd., *Product Brochure* "3–Methyl–3–Methoxy Butanol", (Feb. 1992) pp. 1–14.

Morris et al., "Propylene–Based Glycol Ethers", *Household and Personal Products Industry*, (May 1982) pp. 48, 50, 52, 54.

Rörig, H, et al. "Amine Oxides and Their Applications," *La Rivista Italiana Delle Sostanze Grasse*, vol. LXVII, *Guigno* (1991) pp. 317–321.

Stephan, R. "Cationic Surfactants in Cleaner Formulations", *Tenside Surf. Det* 29 (1992) pp. 205–210.

Union Carbide, "Ethers for Household and Institutional Products", (1976) pp. 1–14.

*Primary Examiner*—Gregory Webb
(74) *Attorney, Agent, or Firm*—Sean J. Edman

(57) ABSTRACT

Improved cleaning compositions are described that are efficient in removing both food and industrial grease, heel marks, and the like from hard surfaces, wherein improved cleaning compositions contain certain nonionic surfactants and quaternary amine salts, when combined with a slightly water-soluble polar organic compound that have a surprising synergistic effect resulting in a marked improvement in the removal of hydrocarbon-containing soils as shown by decreased soaking times required for soil removal.

20 Claims, No Drawings

U.S. PATENT DOCUMENTS 4,501,680 A 2/1985 Aszman et al. ..... 252/142
4,552,685 A 11/1985 Kernstock et al. ..... 252/355
4,561,991 A 12/1985 Herbots et al. ..... 252/118
4,576,728 A 3/1986 Stoddart ..... 252/102
4,587,030 A 5/1986 Casey ..... 252/92
4,597,887 A * 7/1986 Colodney et al. ..... 510/384
4,606,842 A 8/1986 Keyes et al. ..... 252/174.23
4,606,850 A 8/1986 Malik ..... 252/528
4,615,819 A 10/1986 Leng et al. ..... 252/110
4,673,523 A 6/1987 Smith et al. ..... 252/91
4,726,915 A 2/1988 Verdicchio ..... 252/542
4,732,695 A 3/1988 Francisco ..... 252/162
4,737,296 A * 4/1988 Watkins ..... 507/202
4,741,863 A 5/1988 Yamamoto et al. ..... 252/547
4,749,508 A 6/1988 Cockrell, Jr. et al. ..... 252/136
4,749,509 A 6/1988 Kacher ..... 252/139
4,758,377 A 7/1988 Iding et al. ..... 252/556
4,767,563 A 8/1988 Buzzaccarini ..... 252/174.25
4,769,172 A 9/1988 Siklosi ..... 252/153
4,776,974 A 10/1988 Stanton et al. ..... 252/106
4,790,951 A 12/1988 Witpenn, Jr. et al. ..... 252/547
4,798,721 A * 1/1989 Yahagi et al. ..... 424/70.16
4,814,109 A 3/1989 Frieser et al. ..... 252/162
4,857,114 A 8/1989 Brumbaugh et al. ..... 134/42
4,863,629 A 9/1989 Osberghaus et al. ..... 252/162
4,891,147 A 1/1990 Gray et al. ..... 252/104
4,900,962 A 2/1990 Clark ..... 252/547
4,921,629 A * 5/1990 Malihi et al. ..... 510/365
4,927,556 A 5/1990 Pokoray ..... 252/173
4,931,726 A 6/1990 Kasukabe et al. ..... 324/158 F
4,954,335 A * 9/1990 Janchipraponvej ..... 424/70.28
4,975,218 A 12/1990 Rosser ..... 252/117
5,019,289 A 5/1991 Gray et al. ..... 252/95
5,021,195 A 6/1991 Machin et al. ..... 252/545
5,035,826 A 7/1991 Durbut et al. ..... 252/121
5,041,239 A 8/1991 Rorig et al. ..... 252/315.1
5,049,377 A * 9/1991 Lamb et al. ..... 424/70.121
5,080,822 A 1/1992 Van Eenam ..... 252/170
5,080,831 A 1/1992 Van Eenam ..... 252/558
5,093,031 A 3/1992 Login et al. ..... 252/357
5,102,573 A 4/1992 Han et al. ..... 252/153
5,126,068 A 6/1992 Burke et al. ..... 252/174.21
5,158,710 A 10/1992 Van Eenam ..... 252/539
5,252,245 A 10/1993 Garabedian, Jr. ..... 252/153
5,419,848 A 5/1995 Van Eenam ..... 252/164
5,435,934 A 7/1995 Jon et al. ..... 252/117
5,503,778 A 4/1996 Liu et al. ..... 252/542
5,523,024 A 6/1996 Garabedian, Jr. ..... 252/547
5,573,710 A * 11/1996 McDonell ..... 510/405
5,637,559 A 6/1997 Koreltz et al. ..... 510/201
5,691,289 A * 11/1997 Purcell et al. ..... 510/174
5,922,665 A * 7/1999 Liu ..... 510/365
6,121,224 A * 9/2000 Fonsny et al. ..... 510/384
6,147,047 A * 11/2000 Robbins et al. ..... 510/417
6,559,116 B1 * 5/2003 Godfroid et al. ..... 510/499

* cited by examiner

CLEANING COMPOSITION

FIELD OF THE INVENTION

The present invention relates to a cleaning composition formulated to remove hydrocarbon-containing soils from hard surfaces.

BACKGROUND OF THE INVENTION

Chemical cleaners are a significant portion of the industrial cleaning market. A chemical cleaner is typically aqueous and comprises an organic solvent to solubilize various soils, a surfactant, which serves as a wetting agent, and a builder, which serves to chelate ions present in water, such as magnesium and calcium. The types and ratios of these ingredients can vary considerably depending on the types of soils to be cleaned and the performance desired. It is common that all components are water-soluble.

In some instances, however, particularly with the solvent ingredient, the water solubility can be negligible. In these cases, components commonly called "couplers" or "hydrotropes" are used to increase the apparent water solubility of the organic solvent in the cleaning composition. The amount of coupler required depends on the type of coupler, organic solvent, and the other components of the mixture. It is typically preferred to use the minimum amount of coupler necessary to completely solubilize the solvent, as this tends to reduce the cost of the cleaning composition.

It is well known that removing hydrocarbon-containing soils from surfaces can be extremely difficult. These hydrocarbon-containing soils may include industrial type greases such as motor oil and lithium grease, and food greases such as lard and vegetable oils, as well as a wide range of other oily, greasy materials. The goal of formulating a cleaning composition that will effectively remove greasy residues from a hard surface has lead to a bewildering array of cleaning compositions on the industrial market. In general, the user wishes to achieve fast cleaning using the least amount of cleaning composition possible to avoid leaving behind residual chemical on the surface being cleaned.

There have been attempts to make improved cleaning compositions. They have included compositions providing improved cleaning that were substantially non-streaking on hard surfaces and contain a surfactant of amine oxide and a quaternary amine salt and a slightly polar organic compound. These cleaning solutions are effective for food soils, grease and the like.

Another class of cleaning compositions are those capable of removing hydrophobic soils, such as food grease and the like are those containing a non-ionic surfactant, and a very slightly water soluble organic solvent.

Although many commercially available cleaning compositions are quite effective at cleaning food grease, and others, particularly solvent-based cleaning compositions, are quite effective at removing industrial grease, the development of a cleaning composition that is effective in removing both food and industrial grease has been particularly challenging. Users are always desirous of improved grease removal properties in cleaning compositions, especially those that are capable of penetrating and emulsifying the soil quickly.

SUMMARY OF THE INVENTION

In accordance with the present invention, improved cleaning compositions are described that are efficient in removing both food and industrial grease, heel marks, and the like from hard surfaces. Further, the compositions may have other uses such as removing food soils, grease, and the like from fibrous substrates such as carpet, furniture, and similar substrates. It has been discovered that certain nonionic surfactants and quaternary amine salts, when combined with a slightly water-soluble polar organic compound, have a surprising synergistic effect resulting in a marked improvement in the removal of hydrocarbon-containing soils as shown by decreased soaking times required for soil removal.

Briefly, in one aspect of the present invention, a composition useful as an aqueous cleaner for removing hydrocarbon-containing soils is provided comprising:

a) a nonionic surfactant selected from the group consisting of a nonionic surfactant selected from the group consisting of a branched or linear primary alcohol ethoxylate, a secondary alcohol ethoxylate, a branched decyl/tridecyl alcohol ethoxylate, a branched or linear alkylphenol ethoxylate, a branched or linear alkyl amine ethoxylate, an alkyl ether amine ethoxylate, a branched or linear alcohol alkoxylate, alkyl glycosides, and a mixture thereof;

b) a quaternary amine salt having the general formula (I)

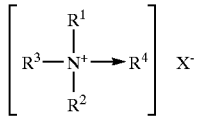

I wherein $R^1$ and $R^2$ are the same or different and are selected from the group consisting of alkyl and substituted alkyl groups, $R^3$ is selected from the group consisting of straight chain alkyls, branched chain alkyls, straight chain heteroalkyls, and branched chain heteroalkyls having from about 10 to 20 carbon atoms, $R^4$ is selected from the group consisting of alkyl groups having from 1 to about 5 carbon atoms (preferably methyl), and X is a halogen atom, preferably atomic chlorine;

c) a slightly water-soluble polar organic compound; and d) water.

Another embodiment of the invention is a method of removing hydrocarbon-containing soils from soiled surfaces comprising the steps of applying to a soiled surface an effective amount of the composition, as described above; and performing a mechanical operation on the surface with an abrasive article after applying the composition to the surface. An optional step of removing the composition from the surface may also be included in the method.

DESCRIPTION OF THE PREFERRED EMBODIMENT(S)

A composition for removing hydrocarbon-containing soils in accordance with the present invention comprises a nonionic surfactant, a quaternary amine salt, a very slightly water-soluble polar organic compound, and water. The composition may also contain other optional but conventional additives.

Nonionic Surfactants

The nonionic surfactant serves the function of decreasing the surface tension of water within the compositions of the invention. Examples of nonionic surfactants useful in the present invention are nonionic surfactants formed by condensation of alkyl phenols, alkyl amines, or aliphatic alcohols with sufficient ethylene oxide, propylene oxide, or a combination thereof, to produce a compound having a polyoxyethylene and/or polyoxypropylene chain within the molecule, that is, a chain composed of recurring (—O—$CH_2$—$CH_2$—) groups, or a chain composed of recurring (—O —$CH_2$—CH—$CH_3$) groups, or a combination thereof. Preferably, the nonionic surfactant is selected from the group consisting of a branched or linear primary alcohol ethoxylate, a secondary alcohol ethoxylate, a branched decyl/tridecyl alcohol ethoxylate, a branched or linear alkylphenol ethoxylate, a branched or linear alkyl amine ethoxylate, an alkyl ether amine ethoxylate, a linear alcohol alkoxylate, and a mixture thereof. Other examples of nonionic surfactants useful in the present invention include alkyl glucosides.

The nonionic surfactants preferably have an HLB value of about 7 to about 16. "HLB," as used herein, refers to an emulsification behavior of a surfactant as well as the relationship between hydrophilic and lipophilic portions of a molecule.

Preferred nonionic surfactants are commercially available and used for their detergent, surface active, wetting and emulsifying properties. One particularly preferred nonionic surfactant used in the invention contains sufficient ethylene oxide units to insure solubility of the nonionic surfactant in the composition or in any dilution thereof that may be used in practice. Another preferred group of nonionic surfactants includes from about 5 moles to about 40 moles of ethylene oxide per mole of nonionic surfactant, and more preferably about 5 moles to about 15 moles of ethylene oxide per mole of nonionic surfactant. Further suitable nonionic surfactants include linear alcohol ethoxylates such as available under the trade designation "TOMADYNE 101LF", commercially available from Tomah Products, Inc., Milton, Wis.; ethoxylated tridecyl alcohols such as "ICONOL TDA6" (having 6 moles of ethylene oxide per mole of ethoxylated tridecyl alcohol), and "ICONOL TDA9" (having 9 moles of ethylene oxide per mole of ethoxylated tridecyl alcohol), commercially available from BASF, Mount Olive, N.J.; "VARONIC K-205" (cocoamine ethoxylate having 5 moles of ethylene oxide per mole of cocoamine ethoxylate), commercially available from Sherex Chemical Co.,Dublin, Ohio; and "TRITON DF-12" (modified polyethoxylated alcohol), commercially available from Dow, Midland, Mich.), alkyl glucosides such as "GLUCPON 425" (a fatty alcohol $C_8$–$C_{16}$ polyglycoside) available from Cognis Corporation, Ambler, Pa.

The weight percent of the nonionic surfactant typically ranges from about 0.1 to about 1.0 weight percent in ready-to-use formulations, with amounts of the surfactant greater than about 1.0 weight percent being uneconomical and not typically rendering a more beneficial wetting property. If the amount of nonionic surfactant is below about 0.1 weight percent, insufficient wetting of the hydrocarbon-containing soil-covered surface may be noticed, but this is not necessarily considered outside of the invention.

It is also contemplated that blends of nonionic and cationic surfactants can be used in the present invention, provided the nonionic surfactant concentration is within the typical weight ranges of a non-blended nonionic surfactant. Examples of such surfactant blends include TOMADYNE 100 and TOMADYNE 102, both commercially available from Tomah Products, Inc., Milton, Wis.

Quaternary Amine Salt Surfactants

Quaternary amine salts are based on the reaction of high molecular weight aliphatic tertiary amines with an alkylating agent such as methyl chloride. They are generally more cationic and more stable to pH change than other amine-based surfactants such as ethoxylated amines. Quaternary amine salts useful as surfactants in the cleaning compositions of the invention which have a synergistic cleaning effect with the nonionic surfactant are those within general formula (I):

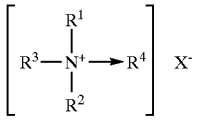

I wherein $R^1$ and $R^2$ are the same or different and are selected from the group consisting of alkyl and substituted alkyl groups, $R^3$ is selected from the group consisting of straight chain alkyls, branched chain alkyls, straight chain heteroalkyls, and branched chain heteroalkyls having from about 10 to 20 carbon atoms, $R^4$ is selected from the group consisting of alkyl groups having from 1 to about 5 carbon atoms (preferably methyl), and X is a halogen atom, preferably atomic chlorine.

Those quaternary amine salts, which are readily combinable with the other ingredients of the compositions of the invention to form one-phase compositions, are preferred. Examples of such quaternary amine salts are "Q-17-5" (isotridecyloxypropyl poly(5) oxyethylene methyl ammonium chloride, and "Q-S-80" (mono soya ammonium chloride quaternary), both available from Tomah Products, Inc., Milton, Wis.

In compositions in accordance with the present invention, the weight ratio of nonionic surfactant to quaternary amine salt typically ranges from about 1:4 to about 4:1, preferably from about 1:2 to about 2:1, and more preferably is about 1:1.

Slightly Water-Soluble Polar Organic Compound

Any number of slightly water-soluble polar organic compounds may be used in the compositions of the invention to promote fast drying properties of the compositions, and to solubilize the hydrocarbon-containing soils.

As used herein the term "slightly water-soluble" means that the polar organic compound has a water solubility ranging from about 0.01 weight percent to about 1.0 weight percent, more preferably ranging from about 0.01 weight percent to about 0.2 weight percent at about 20° C. Preferably, the slightly water soluble polar organic compound is not a hydrocarbon or halocarbon, contains one or more heteroatoms of oxygen, nitrogen, sulfur, phosphorous containing functional groups and contains an alkyl group containing about 7 carbon atoms to about 16 carbon atoms. More preferably, the slightly water soluble polar organic compound contains a moiety selected from the group of an alcohol, an aldehyde, a ketone, an ether, a glycol ether, an acid, an amine, an ester, a pyrrolidone, and a compatible mixture thereof.

Such slightly water-soluble polar organic compounds are commercially available. One preferred class of slightly water-soluble polar organic compounds within the defined solubility range are ethylene glycol ethers having from about 6 to about 12 carbon atoms. An example of a glycol ether meeting this description includes ethylene glycol 2-ethyl hexyl ether "EKTASOLVE EEH" (water solubility of about 0.2 weight), commercially available from Eastman Chemical, Kingsport, Tenn. Another class of slightly water-soluble polar organic compounds useful in the present invention includes normal and branched chain alkyl alcohols having from about 6 to about 12 carbon atoms, such as isooctyl alcohol (water solubility of about 0.06 weight percent). Isooctyl alcohol is commercially available under the tradename "EXXAL 8" from Exxon, Houston, Tex.

Yet another class of slightly water-soluble polar organic compounds useful in the present invention are N-alkyl pyyrolidones having water solubility within the preferred ranges previously mentioned. One useful example is N-octyl pyrrolidone (solubility in water of about 0.124 weight percent), available under the trade designation "SURFADONE LP-100" from International Specialty Products, Wayne, N.J.

Other useful slightly water-soluble polar organic compounds include 1-octanol having a water solubility of about 0.1 weight percent and di-isobutyl ketone having a water solubility of about 0.05 weight percent, both commercially available from Aldrich Chemicals, Milwaukee, Wis.

Use of a mixture of any of the slightly water-soluble polar organic compounds mentioned herein may be used, provided they are compatible with each other and with the other ingredients.

In compositions according to the present invention, the weight ratio of active slightly water-soluble polar organic compound to active surfactant (nonionic surfactant+ quaternary amine salt) typically ranges from about 0.1:1 to about 1:1.

Optional Additives

The compositions of the invention may include other optional but conventional additives. For example, the composition according to the invention may contain a colorant to provide a more aesthetic appearance, a fragrance to provide more acceptable smell, a preservative to prevent bacterial growth in the solution, a suitable anti-microbial agent or bacteriostat to eradicate germs, mold, mildew, and the like. Other surfactants, chelating agents, antioxidants, foaming or anti-foaming agents, film-forming agents, and the like may also be included.

The compositions of the present invention preferably have a pH (i.e., negative logarithm of the hydrogen ion concentration), which renders the compositions basic, i.e., pH greater than 7.0, which renders the compositions more effective in solubilizing grease. One preferred class of pH adjustment chemicals is the low molecular weight alkanol amine compounds such as 2-amino-2-methyl-1-propanol (AMP95, available from Dow, Midland, Mich.), monoethanolamine and the like.

Further, it may be advantageous to include a compatible thickening agent to render the viscosity of the compositions of the invention such that they may be applied to a vertical surface, e.g., a baseboard, and not run therefrom. If such running occurs, the residence time of the composition with respect to the surface being cleaned would be reduced. Alternatively, the composition may run onto areas where it is not wanted.

Methods of Use of the Inventive Compositions

The compositions of the invention can, of course, be made sold and used as concentrates, or in diluted or "ready-to-use" form. When in "ready-to-use" form, the compositions preferably have the same ratios of actives as the concentrates. Actual effective dilution of the concentrates will depend on the intended surface to be cleaned, type of soil, degree of soiling, and the like.

The compositions of the invention may be sprayed upon the soiled surface or simply poured thereon in concentrated or "ready-to-use" form as desired. Spraying can be accomplished by conventional mechanical spraying devices (such as by use of a conventional trigger spray device) or by using an aerosol-dispensing container with a sufficient amount of suitable aerosol propellant such as a low boiling alkanes or mixtures thereof, such as a mixture isobutane and propane. Performing a mechanical operation to the soiled surface after application of a composition of the invention may be desired or required for removing hydrocarbon-containing soils. Performing a mechanical operation may include wiping, abrading, scrubbing, brushing, and the like. However, if the underlying surface is soft and/or decorative, abrading or scrubbing may not be desirable.

An abrasive article that may be used includes, for example, a porous sponge material, or nonwoven or woven article. One preferred nonwoven material is that known under the trade designation "SCOTCH-BRITE," from Minnesota Mining and Manufacturing Company (3M), St. Paul, Minn. Such nonwoven products and their manufacture are described in U.S. Pat. No. 2,958,593 (Hoover et al.). After performing a mechanical operation on the surface, the composition is preferably removed. This can be accomplished by a variety of techniques that are generally known, including, for example, rinsing the composition from the surface, or the compositions may be simply wiped away with an absorbent material.

The objects, features and advantages of the present invention are further illustrated by the following examples, but the particular materials and amounts thereof recited in these examples, as well as other conditions and details, should not be construed to unduly limit this invention. All materials are commercially available or known to those skilled in the art unless otherwise stated or apparent. All parts and percentages in the Examples and the Specification are by weight (based on 100% active material), unless otherwise specified.

Test Methods

Petroleum Grease Removal Test

A standard petroleum grease was prepared (at least 2–7 days prior to testing) consisting of 25 grams 20 weight (2W) oil, 25 grams industrial lithium grease known under the trade designation "STA-Grease" from Conoco Oil Company, 75 grams heptane, 75 grams methylene chloride and 0.2 gram oil soluble dye. These ingredients were mixed in a beaker equipped with a stir bar and placed on a heater/magnetic stirrer and the grease heated to about 30° C. while keeping a watch glass over the beaker. After the composition reached about 30° C. the beaker was removed from the heater/magnetic stirrer and allowed to cool to room temperature with continued stirring with a glass rod. 25 mm×75 mm glass slides were then immersed for a few seconds into the petroleum grease and drawn up quickly so that the grease coated both sides of the slide (25 mm×30 mm on each side). The petroleum grease-coated slides were then dried by hanging at room temperature (about 20° C.) for 24 hours.

In the petroleum grease removal test, 140 ml of the composition to be tested was placed into a 150 ml glass beaker equipped with a magnetic stir bar. The beaker was then placed on a magnetic stirrer and the power setting adjusted until the bar rotated at 2000 rpm, using a strobe light to adjust the speed of rotation. The coated glass slide to be cleaned was then suspended vertically in the composition to be tested, coated portion pointing toward the bottom of the beaker with the other end attached to a suitable support, so that the glass slide did not touch anything but the composition being tested, and the stir bar did not hit the glass slide or the sides of the beaker. The percent removal of the petroleum grease was measured visually versus time for each slide and composition tested. Slides were not reused. This is a relative test that should be done as a comparison rather than an absolute scale.

Food Grease Removal Test

In the food grease removal tests, a standard food grease solution consisting of equal amounts of soy bean oil (10 grams) and lard (10 grams) dissolved in enough methylene chloride (60 grams) to form a solution was prepared. A small amount of oil blue pigment (0.1 gram) was added to the solution. 25 mm×75 mm glass slides were then immersed for a few seconds into the food grease and drawn up quickly so that the food grease coated both sides of the slide (25 mm×30 mm on each side). The food grease-coated slides were then dried or "cured" by hanging at room temperature (about 20° C.) for 24 hours. (To make the test more difficult, the slides may be aged for up to a week but all comparisons should be done on the same batch of slides aged identically.)

In the food grease removal test, 140 milliliters (ml) of the composition to be tested were placed into a 150 ml glass beaker equipped with a magnetic stir bar (2.5 cm in length). The beaker was then placed on a magnetic stirrer. The coated glass slide to be cleaned was then suspended vertically in the composition to be tested, coated portion pointing toward the bottom of the beaker with the other end attached to a suitable support, so that the glass slide did not touch anything but the composition being tested, and the stir bar did not hit the glass slide or the sides of the beaker. The magnetic stirrer was immediately turned on and the stirring speed adjusted with a strobe light to 2000 rpm, after which the percent removal of food grease versus time was measured visually for each side of the slide. Slides were not reused.

Reproducibility for the petroleum grease and food grease removal test methods was about +/−5%.

Glossary

""TOMADYNE 101LF" is a linear alcohol ethoxylate, available from Tomah Products, Inc., Milton, Wis.

"TOMADYNE 100" and "TOMADYNE 102" are linear alcohol ethoxylate and cationic surfactant blends, available from Tomah Products, Inc., Milton, Wis.

"ICONOL TDA6" is an ethoxylated tridecyl alcohol (having 6 moles of ethylene oxide per mole of ethoxylated tridecyl alcohol), available from BASF, Mount Olive, N.J.

VARONIC K-205" is a cocoamine ethoxylate (having 5 moles of ethylene oxide per mole of cocoamine ethoxylate), available from Sherex Chemical Co.,Dublin, Ohio.

"TRITON DF-12" is a modified polyethoxylated alcohol, available from Dow, Midland, Mich.

"GLUCPON 425" is an alkyl glucosides (a fatty alcohol $C_8$–$C_{16}$ polyglycoside), available from Cognis Corporation, Ambler, Pa.;

"Q-17-5" is isotridecyloxypropyl poly(5) oxyethylene methyl ammonium chloride (75%), available from Tomah Products, Inc., Milton, Wis.

"Q-S-80" is mono soya ammonium chloride quaternary (80%), available from Tomah Products, Inc., Milton, Wis.

"Q-S-T-50" is trimethyl stearyl ammonium chloride quaternary (50%), available from Tomah Products, Inc., Milton, Wis.

"EKTASOLVE EEH" is ethylene glycol 2-ethyl hexyl ether, available from Eastman Chemical, Kingsport, Tenn.

"EXXAL 8" is isooctyl alcohol, available from Exxon, Houston, Tex.

"AMP95" is 2-amino-2-methylpropanol, available from Dow, Midland, Mich.

"Dequest 2010" is 1-Hydroxyethylidene-1-1-diphosphonic acid, available from Monsanto Company, St Louis, Mo.

EXAMPLES

Example 1 and Comparative Examples A–E

The compositions of Example 1 and Comparative Examples A–F as "ready-to-use" formulations are provided in Table 1. Example 1 was formulated to include a nonionic surfactant, a quaternary amine salt surfactant, and a slightly water-soluble polar organic compound. Comparative Example A was formulated to include only the nonionic surfactant "TOMADYNE 101LF". Comparative Example B was formulated to include only the quaternary amine salt surfactant "Q-17-5". Comparative Example C was formulated to include only the slightly water-soluble polar organic compound "EEH". Comparative Example D was formulated to include only the "TOMADYNE 101LF" and the "EEH". Comparative Example E was formulated to include only the "Q-17-5" and the "EEH". Comparative Example F was formulated to include only the "TOMADYNE 101LF" and the "Q-17-5". These compositions were subjected to the petroleum grease and food grease removal tests, as described above. These results are shown in Table 2. The data in Table 2 demonstrated that there appeared to be a synergistic effect of the nonionic surfactant, the quaternary amine salt surfactant, and the slightly water-soluble polar organic compound as evidenced by the decreased soaking time required to achieve nearly 100% grease removal for Example 1.

TABLE 1

| Example No.: | 1 | Comp. Ex. A | Comp. Ex. B | Comp. Ex. C | Comp. Ex. D | Comp. Ex. E | Comp. Ex. F |
|---|---|---|---|---|---|---|---|
| Surfactants | | | | | | | |
| TOMADYNE 101LF | 0.13 | 0.26 | — | — | 0.26 | — | 0.13 |
| Q-17-5 | 0.13 | — | 0.26 | — | — | 0.26 | 0.13 |
| Slightly water-soluble Polar organic compound | | | | | | | |
| EEH | 0.07 | — | — | 0.07 | 0.07 | 0.07 | — |
| Additives | | | | | | | |
| AMP95 | 0.21 | 0.21 | 0.21 | 0.21 | 0.21 | 0.21 | 0.21 |
| Dequest 2010 | 0.002 | 0.002 | 0.002 | 0.002 | 0.002 | 0.002 | 0.002 |
| DI water | balance | balance | balance | balance | balance | balance | balance |

TABLE 2

| Example No.: | 1 | Comp. Ex. A | Comp. Ex. B | Comp. Ex. C | Comp. Ex. D | Comp. Ex. E | Comp. Ex. F |
|---|---|---|---|---|---|---|---|
| | Grease Removal Rate (%) | | | | | | |
| Petroleum grease removal | | | | | | | |
| 5 min | 50 | 0 | 2 | 0 | 0 | 2 | 5 |
| 10 min | 99 | 2 | 5 | 0 | 2 | 5 | 40 |
| 15 min | — | 2 | 5 | 0 | 2 | 35 | 85 |
| Food grease removal | | | | | | | |
| 5 min | 95 | 5 | 10 | 0 | 100 | 100 | — |

Examples 2 and 3

Examples 2 and 3 were the same as Example 1 except that N-octyl pyrrolidone and "EXXAL 8", respectively, were used as the slightly water-soluble polar compounds instead of "EEH". These compositions were subjected to the petroleum grease and food grease removal tests, as described above. These results are shown in Table 3.

TABLE 3

| Example No.: | 2 | 3 |
|---|---|---|
| | Grease Removal Rate (%) | |
| Petroleum grease removal | | |
| 5 min | 45 | 45 |
| 10 min | 92 | 90 |
| 15 min | — | — |
| Food grease removal | | |
| 5 min | 100 | 100 |

Example 4 and Comparative Examples G–I

Example 4 was the same as Example 1 except that the nonionic surfactant used was "TRITON DF-12". Comparative Example G, similar to Comparative Example A, was formulated to include only the "TRITON DF-12". Comparative Example H, similar to Comparative Example D, was formulated to include only the "TRITON DF-12" and the "EEH". Comparative Example I, similar to Comparative Example F, was formulated to include only the "TRITON DF-12" and the "Q-S-T-50". These compositions were subjected to the petroleum grease and food grease removal tests, as described above. These results are shown in Table 4.

TABLE 4

| Example No.: | 4 | Comp. Ex. G | Comp. Ex. H | Comp. Ex. I |
|---|---|---|---|---|
| | Grease Removal Rate (%) | | | |
| Petroleum grease removal | | | | |
| 5 min | 50 | 0 | 0 | 0 |
| 10 min | 95 | 0 | 0 | 5 |
| 15 min | — | 0 | 0 | 10 |
| Food grease removal | | | | |
| 5 min | 100 | — | 99 | — |

Example 5 and Comparative Examples J–N

Example 5 was the same as Example 1 except that the nonionic surfactant used was "ICONOL TDA-6" and the quaternary amine salt surfactant use was "Q-S-80". Comparative Example J, similar to Comparative Example A, was formulated to include only the "ICONOL TDA-6". Comparative Example K, similar to Comparative Example B, was formulated to include only the "Q-S-80". Comparative Example L, similar to Comparative Example D, was formulated to include only the "ICONOL TDA-6" and the "EEH". Comparative Example M, similar to Comparative Example E, was formulated to include only the "Q-17-5" and the "EEH". Comparative Example N, similar to Comparative Example F, was formulated to include only the "ICONOL TDA-6" and the "Q-17-5. These compositions were subjected to the petroleum grease and food grease removal tests, as described above. These results are shown in Table 5.

TABLE 5

| Example No.: | 5 | Comp. Ex. J | Comp. Ex. K | Comp. Ex. L | Comp. Ex. M | Comp. Ex. N |
|---|---|---|---|---|---|---|
| | Grease Removal Rate (%) | | | | | |
| Petroleum grease removal | | | | | | |
| 5 min | 75 | 3 | 0 | 4 | 0 | 0 |
| 10 min | 100 | 5 | 2 | 33 | 0 | 0 |
| 15 min | — | 20 | 4 | 50 | 0 | 0 |
| Food grease removal | | | | | | |
| 5 min | 100 | — | — | 100 | 90 | — |

Example 6 and Comparative Examples O–Q

Example 6 was the same as Example 1 except that the nonionic surfactant used was "VARONIC K-205". Comparative Example O, similar to Comparative Example A, was formulated to include only the "VARONIC K-205". Comparative Example P, similar to Comparative Example D, was formulated to include only the "VARONIC K-205" and the "EEH". Comparative Example Q, similar to Comparative Example F, was formulated to include only the "VARONIC K-205" and the "Q-17-5". These compositions were subjected to the petroleum grease and food grease removal tests, as described above. These results are shown in Table 6.

TABLE 6

| | Grease Removal Rate (%) | | | |
|---|---|---|---|---|
| Example No.: | 6 | Comp. Ex. O | Comp. Ex. P | Comp. Ex. Q |
| Petroleum grease removal | | | | |
| 5 min | 40 | 0 | 0 | 2 |
| 10 min | 75 | 2 | 3 | 10 |
| 15 min | 90 | 5 | 5 | 40 |
| Food grease removal | | | | |
| 5 min | 90 | 10 | 80 | — |

Examples 7 and 8 and Comparative Examples R–V

Example 7 was the same as Example 1 except that the nonionic surfactant used was "GLUCOPON 425". Example 8 was the same as Example 7 except that the quaternary amine salt surfactant used was "Q-S-T-50". Comparative Example R, similar to Comparative Example A, was formulated to include only the "GLUCOPON 425". Comparative Example S, similar to Comparative Example B, was formulated to include only the "Q-S-T-50". Comparative Example T, similar to Comparative Example D, was formulated include only the "GLUCOPON 425" and the "EEH". Comparative Example U, similar to Comparative Example E, was formulated to include only the "Q-S-T-50" and "EEH". Comparative Example V, similar to Comparative Example F, was formulated to include only the "GLUCOPON 425" and the "Q-S-T-50" and "EEH". These compositions were subjected to the petroleum grease and food grease removal tests, as described above. These results are shown in Table 7.

TABLE 7

| | Grease Removal Rate (%) | | | | | | |
|---|---|---|---|---|---|---|---|
| Example No.: | 7 | 8 | Comp. Ex. R | Comp. Ex. S | Comp. Ex. T | Comp. Ex. U | Comp. Ex. V |
| Petroleum grease removal | | | | | | | |
| 5 min | 40 | 45 | 0 | 0 | 0 | 0 | 0 |
| 10 min | 80 | 85 | 0 | 0 | 10 | 0 | 6 |
| 15 min | 99 | 99 | 0 | 0 | 20 | 0 | 12 |
| Food grease removal | | | | | | | |
| 5 min | 100 | 95 | 5 | — | 85 | 90 | — |

Various modifications and alterations of this invention will become apparent to those skilled in the art without departing from the scope and principles of this invention, and it should be understood that this invention is not to be unduly limited to the illustrative embodiments set forth hereinabove.

What is claimed:

1. A composition for removing hydrocarbon-containing soils comprising:

a) a nonionic surfactant selected from the group consisting of a branched or linear primary alcohol ethoxylate, a secondary alcohol ethoxylate, a branched decyl/tridecyl alcohol ethoxylate, a branched or linear alkylphenol ethoxylate, a branched or linear alkyl amine ethoxylate, an alkyl ether amine ethoxylate, a branched or linear alcohol alkoxylate, alkyl glycosides, and a mixture thereof;

b) a quaternary amine salt surfactant within the general formula (I)

I

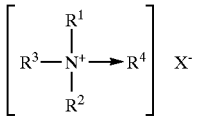

wherein $R^1$ and $R^2$ are the same or different and are selected from the group consisting of alkyl and substituted alkyl groups, R3 is selected from the group consisting of straight chain alkyls, branched chain alkyls, straight chain heteroalkyls, and branched chain heteroalkyls having from about 10 to 20 carbon atoms, $R^4$ is selected from the group consisting of alkyl groups having from 1 to about 5 carbon atoms, and X is a halogen atom; and a solvent system consisting essentially of:

c) a slightly water-soluble polar organic compound; and d) water wherein the weight ratio of slightly water-soluble polar organic compound (c) to the total amount of nonionic surfactant and quaternary amine salt surfactant present (a+b) ranges from about 0.1:1 to about 0.27:1.

2. The composition of claim 1 wherein the slightly water-soluble polar organic compound has a water solubility from about 0.01% by weight to about 1.0 weight percent.

3. The composition of claim 2 wherein the slightly water-soluble polar organic compound has a water solubility from about 0.01% by weight to about 0.2% by weight.

4. The composition of claim 1 wherein the slightly water-soluble polar organic compound is not a hydrocarbon or halocarbon, contains one or more heteroatoms of oxygen, nitrogen, sulfur, phosphorous containing functional groups and contains an alkyl group containing about 7 carbon atoms to about 16 carbon atoms.

5. The composition of claim 4 wherein the slightly water-soluble polar organic compound contains a moiety selected from the group of an alcohol, an aldehyde, a ketone, an ether, a glycol ether, an acid, an amine, an ester, an N-alkyl pyrrolidone, and a compatible mixture thereof.

6. The composition of claim 1 wherein the nonionic surfactant has an HLB value of about 7 to about 16.

7. The composition of claim 1 wherein the weight ratio of nonionic surfactant to quaternary amine salt surfactant ranges from about 1:4 to about 4:1.

8. The composition of claim 7 wherein the weight ratio of nonionic surfactant to quaternary amine salt surfactant ranges from about 1:2 to about 2:1.

9. The composition of claim 8 wherein the weight ratio of nonionic surfactant to quaternary amine salt surfactant is about 1:1.

10. The composition of claim 1, further including at least one additive wherein the at least one additive is selected from a pH adjuster, a colorant, a fragrance, a preservative, an anti-microbial agent, a foaming agent, an anti-foaming agent, a film-forming agent, a thickener, and a mixture thereof.

11. The composition of claim 1 wherein the composition consists essentially of:

a) a nonionic surfactant selected from the group consisting of a branched or linear primary alcohol ethoxylate, a secondary alcohol ethoxylate, a branched decyl/tridecyl alcohol ethoxylate, a branched or linear alkylphenol ethoxylate, a branched or linear alkyl amine ethoxylate, an alkyl ether amine ethoxylate, a branched or linear alcohol alkoxylate, alkyl glycosides, and a mixture thereof;

b) a quaternary amine salt surfactant within the general formula (I)

I

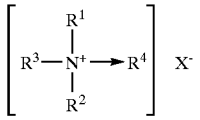

wherein $R^1$ and $R^2$ are the same or different and are selected from the group consisting of alkyl and substituted alkyl groups, $R^3$ is selected from the group consisting of straight chain alkyls, branched chain alkyls, straight chain heteroalkyls, and branched chain heteroalkyls having from about 10 to 20 carbon atoms, $R^4$ is selected from the group consisting of alkyl groups having from 1 to about 5 carbon atoms, and X is a halogen atom;

c) a slightly water soluble polar organic compound having a water solubility from about 0.01% by weight to about 1.0 weight percent;

d) a pH adjuster;

e) a colorant;

f) a fragrance; and g) water.

12. A composition for removing hydrocarbon-containing soils consisting essentially of:

a) a nonionic surfactant selected from the group consisting of a branched or linear primary alcohol ethoxylate, a secondary alcohol ethoxylate, a branched decyl/tridecyl alcohol ethoxylate, a branched or linear alkylphenol ethoxylate, a branched or linear alkyl amine ethoxylate, an alkyl ether amine ethoxylate, a branched or linear alcohol alkoxylate, alkyl glycosides, and a mixture thereof;

b) a quaternary amine salt surfactant within the general formula (I)

I

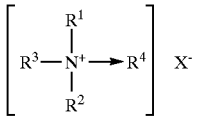

wherein $R^1$ and $R^2$ are the same or different and are selected from the group consisting of alkyl and substituted alkyl groups, $R^3$ is selected from the group consisting of straight chain alkyls, branched chain alkyls, straight chain heteroalkyls, and branched chain heteroalkyls having from about 10 to 20 carbon atoms, $R^4$ is selected from the group consisting of alkyl groups having from 1 to about 5 carbon atoms, and X is a halogen atom;

c) a slightly water soluble polar organic compound having a water solubility from about 0.01% by weight to about 1.0 weight percent;

d) an optional pH adjuster;

e) an optional colorant;

f) an optional fragrance; and g) water.

13. The composition of claim 12, wherein the composition contains d) a pH adjuster;

e) a colorant;

f) a fragrance.

14. The composition of claim 12, wherein the composition consists essentially of:

a) a nonionic surfactant selected from the group consisting of a branched or linear primary alcohol ethoxylate, a secondary alcohol ethoxylate, a branched decyl/tridecyl alcohol ethoxylate, a branched or linear alkylphenol ethoxylate, a branched or linear alkyl amine ethoxylate, an alkyl ether amine ethoxylate, a branched or linear alcohol alkoxylate, alkyl glycosides, and a mixture thereof;

b) a quaternary amine salt surfactant consisting of trimethyl stearyl ammonium chloride;

c) a slightly water soluble polar organic compound consisting of ethylene glycol 2-ethyl hexyl ether;

d) an optional pH adjuster;

e) an optional colorant;

f) an optional fragrance; and g) water.

15. The composition of claim 13, wherein the composition consists essentially of:

a) a nonionic surfactant selected from the group consisting of a branched or linear primary alcohol ethoxylate, a secondary alcohol ethoxylate, a branched decyl/tridecyl alcohol ethoxylate, a branched or linear alkylphenol ethoxylate, a branched or linear alkyl amine ethoxylate, an alkyl ether amine ethoxylate, a branched or linear alcohol alkoxylate, alkyl glycosides, and a mixture thereof;

b) a quaternary amine salt surfactant consisting of trimethyl stearyl ammonium chloride;

c) a slightly water soluble polar organic compound consisting of ethylene glycol 2-ethyl hexyl ether;

d) a pH adjuster consisting of 2-amino-2-methyl-1-propanol;

e) a colorant;

f) a fragrance; and g) water.

16. The composition of claim 12, wherein the weight ratio of slightly water-soluble polar organic compound (c) to the total amount of nonionic surfactant and quaternary amine salt surfactant present (a+b) ranges from about 0.1:1 to about 1:11.

17. The composition of claim 12, wherein the weight ratio of slightly water-soluble polar organic compound (c) to the total amount of nonionic surfactant and quaternary amine salt surfactant present (a+b) ranges from about 0.1:1 to about 0.27:1.

18. A composition for removing hydrocarbon-containing soils consisting essentially of:

a) a nonionic surfactant selected from the group consisting of a branched or linear primary alcohol ethoxylate, a secondary alcohol ethoxylate, a branched decyl/tridecyl alcohol ethoxylate, a branched or linear alkylphenol ethoxylate, a branched or linear alkyl amine ethoxylate, an alkyl ether amine ethoxylate, a branched or linear alcohol alkoxylate, alkyl glycosides, and a mixture thereof;

b) a quaternary amine salt surfactant consisting of trimethyl stearyl ammonium chloride;

c) a slightly water soluble polar organic compound consisting of ethylene glycol 2-ethyl hexyl ether;

d) an optional pH adjuster;

e) an optional colorant;

f) an optional fragrance; and g) water.

19. The composition of claim 18, wherein the weight ratio of slightly water-soluble polar organic compound (c) to the total amount of nonionic surfactant and quaternary amine salt surfactant present (a+b) ranges from about 0.1:1 to about 1:1.

20. The composition of claim 18, wherein the weight ratio of slightly water-soluble polar organic compound (c) to the total amount of nonionic surfactant and quaternary amine salt surfactant present (a+b) ranges from about 0.1:1 to about 0.27:1.

* * * * *

UNITED STATES PATENT AND TRADEMARK OFFICE

CERTIFICATE OF CORRECTION

PATENT NO. : 6,849,589 B2
DATED : February 1, 2005
INVENTOR(S) : Liu, Augustine C.

It is certified that error appears in the above-identified patent and that said Letters Patent is hereby corrected as shown below:

Title page,
Item [56], References Cited, OTHER PUBLICATIONS, "Exxon Chemical Co.," reference, after "pp." insert -- 1- --

Column 1,
Line 54, delete "water-soluble" and insert -- water-soluble --, therefor.

Column 2,
Line 24, after "formula (I)" insert -- : --

Column 4,
Lines 46 and 51, delete "water soluble" and insert -- water-soluble --, therefor.

Column 7,
Line 32, before ""TOMADYNE" delete " " "
Line 48, after "Pa." delete ";"

Column 10,
Line 47, after "Q-17-5" insert -- " --.

Column 12,
Line 38, after "water" insert -- ; --.

Column 13,
Line 56, delete "water soluble" and insert -- water-soluble --, therefor.

Column 14,
Lines 26 and 52, delete "water soluble" and insert -- water-soluble --, therefor.
Line 36, before "a pH" delete "d)" and insert -- a) --, therefor.
Line 37, before "a colorant" delete "e)" and insert -- b) --, therefor
Line 38, before "a fragrance" delete "f)" and insert -- c) --, therefor.
Line 58, after "Claim 13" delete ",".

Column 15,
Line 3, delete "water soluble" and insert -- water-soluble --, therefor.
Line 15, delete "1:11" and insert -- 1:1 --.

UNITED STATES PATENT AND TRADEMARK OFFICE

CERTIFICATE OF CORRECTION

PATENT NO. : 6,849,589 B2
DATED : February 1, 2005
INVENTOR(S) : Liu, Augustine C.

It is certified that error appears in the above-identified patent and that said Letters Patent is hereby corrected as shown below:

Column 16,
Line 7, delete "water soluble" and insert -- water-soluble --, therefor.

Signed and Sealed this

Thirty-first Day of May, 2005

JON W. DUDAS
*Director of the United States Patent and Trademark Office*